United States Patent [19]

Steinhilber

[11] 4,164,859

[45] Aug. 21, 1979

[54] WIRE ACCUMULATOR

[75] Inventor: Wilhelm A. Steinhilber, Guilford, Conn.

[73] Assignee: Orion Machinery and Engineering Corporation, Branford, Conn.

[21] Appl. No.: 857,572

[22] Filed: Dec. 5, 1977

[51] Int. Cl.[2] ..... B21C 1/14

[52] U.S. Cl. ..... 72/289

[58] Field of Search ..... 72/289, 279, 280, 288

[56] References Cited

U.S. PATENT DOCUMENTS

| | | | |
|---|---|---|---|
| 1,865,781 | 7/1932 | Najarian | 72/280 |
| 1,933,755 | 11/1933 | Poulsen | 72/289 |
| 2,237,371 | 4/1941 | Simons | 72/289 |
| 3,368,382 | 2/1968 | Fleshman | 72/289 |

FOREIGN PATENT DOCUMENTS

| | | | |
|---|---|---|---|
| 938904 | 1/1956 | Fed. Rep. of Germany | 72/289 |
| 2052767 | 11/1972 | Fed. Rep. of Germany | 72/289 |

*Primary Examiner*—Michael J. Keenan

*Attorney, Agent, or Firm*—DeLio and Montgomery

[57] ABSTRACT

A frictional coupling adjusting mechanism for a double block accumulator including means for limiting the rate at which the coupling force may be increased after a predetermined force is reached, and also limiting the total coupling force that may be applied.

8 Claims, 6 Drawing Figures

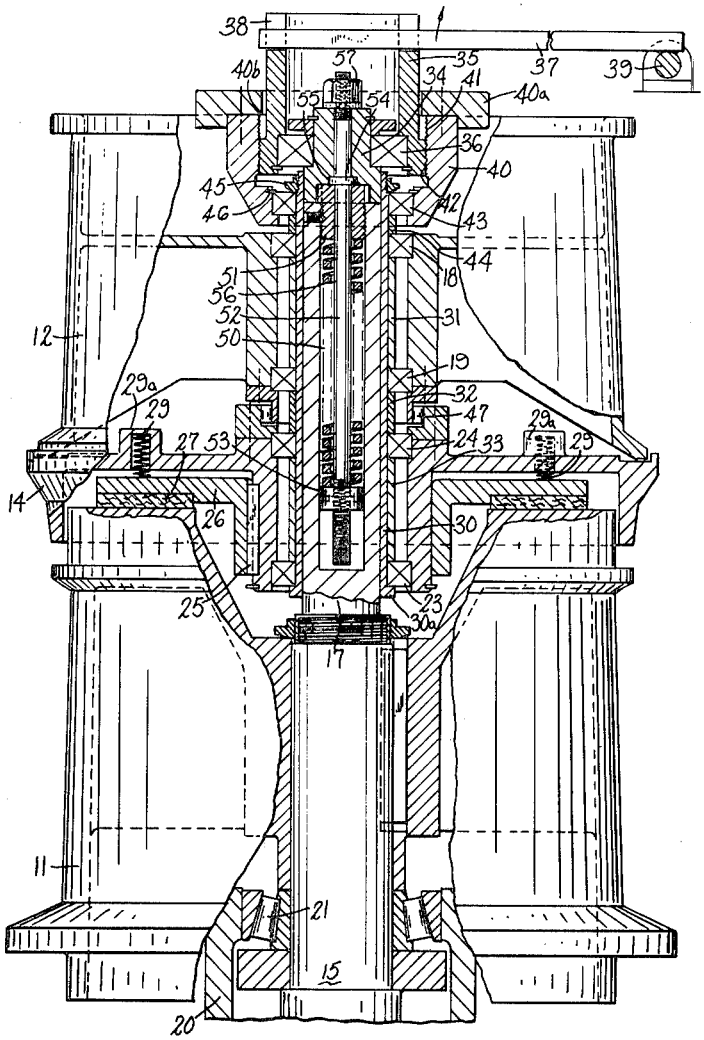

38
1
37
39
35
57
34
41
40b
40a
55
54
36
40
45
42
46
43
44
18
51
56
52
31
50
12
19
29a
32
29
47
29a
27
53
24
33
29
14
26
30
25
23
30a
17
11
21
15
20

WIRE ACCUMULATOR

This invention relates to wire drawing and more particularly relates to a wire accumulator used in a wire drawing operation.

When wire is processed by being drawn through a die, it may pass to an accumulating device which comprises a lower drive block or drum which exerts tension on the wire to pull the wire through the die. Thereafter, this wire accumulated on the lower block is passed about a sheave and wound in a reverse direction on an upper block which is rotatable with respect to the lower block. Such apparatus is generally referred to as a double block accumulator. Dependent upon the degree of a frictional coupling, which permits relative rotation of the upper and lower blocks, wire may be accumulated on either block. The speed of the relative rotation of the upper block will determine the payout of accumulated wire therefrom. The torque of the upper block is determined by a variable frictional coupling between the upper and lower blocks and therefore the tension exerted on the wire leaving the upper block.

For example, if the upper drum rotates at a greater number of revolutions per unit time than the lower drum, there will be a net decrease in the wire stored on both drums. If the upper drum is coupled to rotate at a lower number of revolutions per unit time than the lower drum, more wire will be stored on the lower drum. Dependent on the degree of relative rotation of the drums, more or less wire may be accumulated on one drum. The degree of coupling together with the tension in the wire determines the mode of operation of the accumulator.

A double block accumulator, as described, may be utilized between drawing dies or it may be utilized to supply finished wire to a spooling device. A problem that often occurs in the operation of double block accumulators is the operator or supervisor of the processing line will make adjustments which result in too high a frictional coupling between the upper and lower blocks. This will lead to rapid wear of the coupling member leading to an increased rate of replacement of the frictional coupling member which further results in down time of the wire drawing line.

The present invention provides a new and improved frictional coupling adjusting means for a double block accumulator of the type described and further provides a means for limiting the axial coupling force between the blocks and regulating the coupling force which may be applied.

The invention in one form thereof comprises the provision of a first member which is rotatably mounted to the shaft of the upper drum but normally held against rotation. An adjusting member is threaded to the first member so that it may be rotated to exert an axial force on the upper block to produce frictional coupling to the lower block. When the axial coupling force reaches a predetermined value, the first member is moved upwardly so that further attempt to increase the axial force results in a substantially decreased rate of application of such force and then limits the force that can be applied. This is accomplished in one form by biasing one of the threaded members with a predetermined force so that it is in essence rigid with the shaft of the upper drum until the predetermined coupling force is reached and overcomes the predetermined bias. Then, further movement of the threaded adjusting member on the first member will result in vertical movement of the first member, substantially reducing the rate of application of coupling pressure, and limiting the pressure which can be applied.

An object of this invention is to provide a new and improved mechanism for controlling the coupling pressure between the blocks of a double block accumulator of the type described.

Another object of this invention is to provide a new and improved mechanism for limiting the frictional coupling force which may be applied between the blocks of a double block accumulator.

A further object of this invention is to provide a new and improved frictional coupling adjusting mechanism for a double block accumulator in which the amount of coupling force which can be obtained is limited to a predetermined value in the relationship of motion of the coupling adjustment to coupling pressure, and after such limit is reached to permit the coupling pressure to be increased only at a substantially reduced rate.

The features of the invention which are believed to be novel are particularly pointed out and distinctly claimed in the concluding portion of this specification. The invention, however, both as to its organization and operation may best be appreciated by reference to the following detailed description taken in conjunction with the drawings, wherein:

Figure 1:
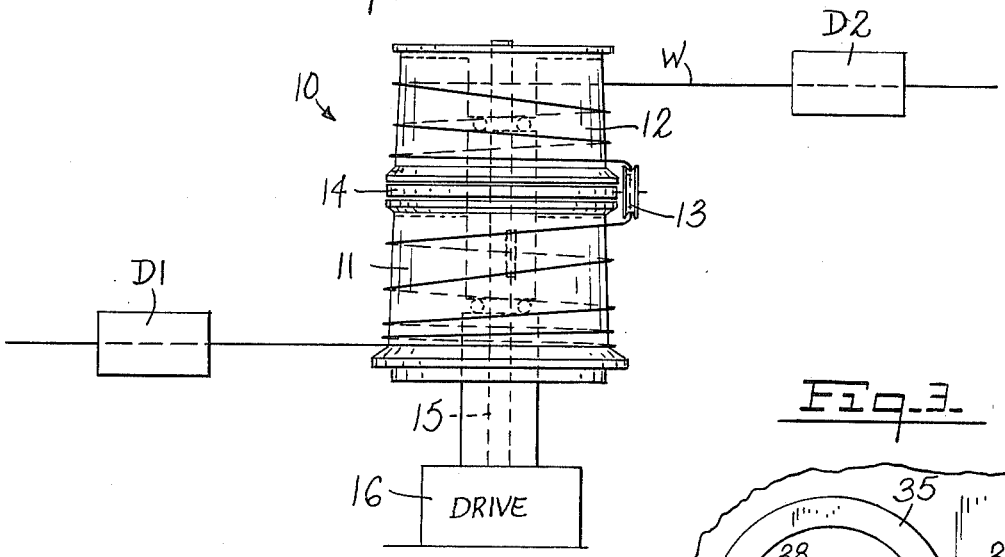
FIG. 1 is a view in elevation of a double block accumulator in a wire processing line.

A double drum accumulator 10 is exemplified in FIG. 1 and comprises a lower driven drum or block 11 and an upper drum or block 12 which is rotatable with respect to block 11 but frictionally coupled thereto as hereinafter described. Wire W is drawn by driven block 11 through a die D1. A plurality of turns of the wire W is wound about lower block 11, then passes on a sheave 13 and is wound on upper block 12 in the reverse direction. Sheave 13 is carried on an idler 14 as hereinafter described. Thereafter, the wire may be payed out to a further drawing die D2 or to a spooler (not shown). The turns of wire about each block will normally be greater than exemplified. The ability of the upper block to rotate relative to the lower block permits a continued supply of wire to die D2, or the spooler, in the event of temporary stoppage of drum 11. In the event of stoppage of wire to die D2 or to a spooler, the wire may accumulate on upper block 12.

Figure 2:
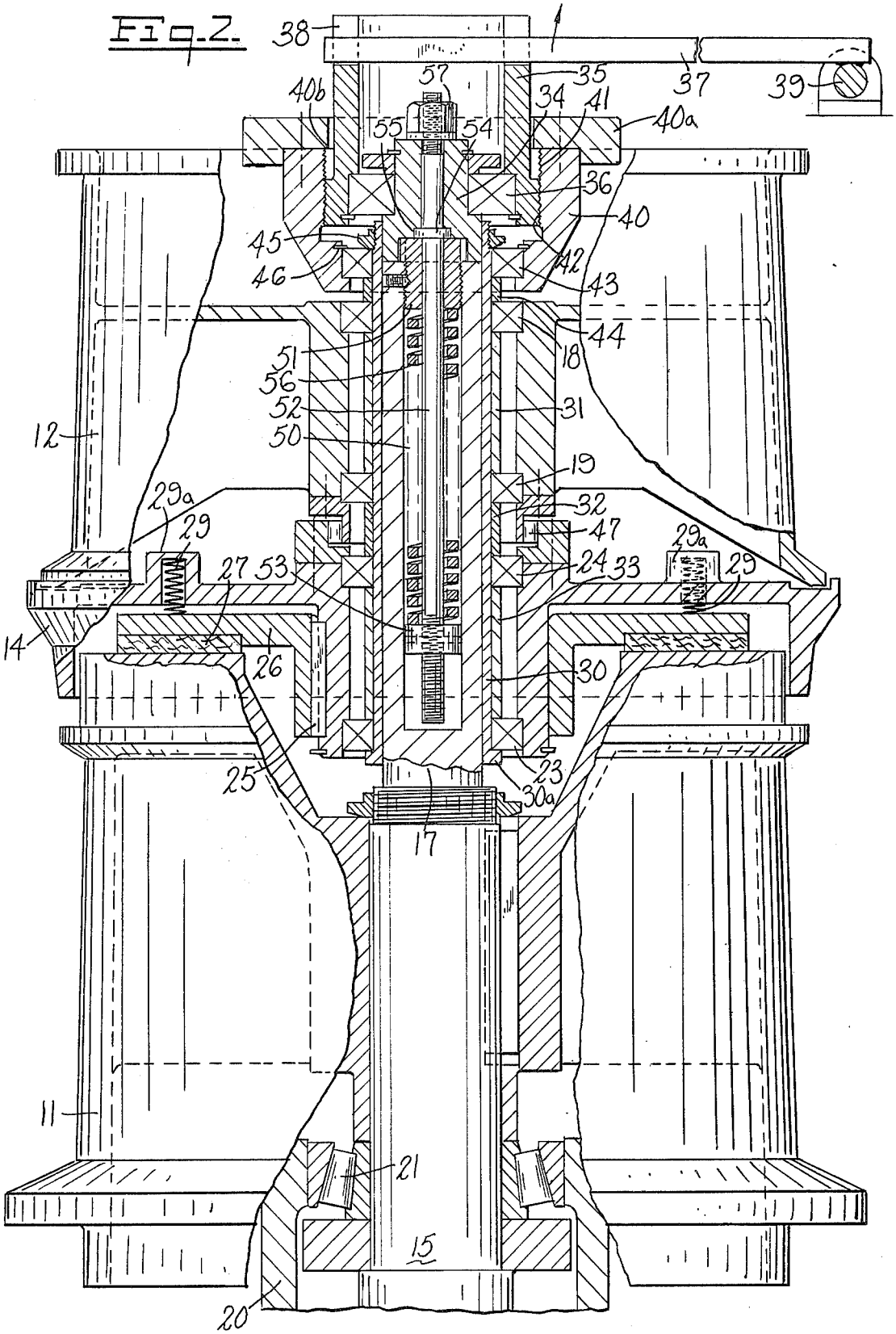
FIG. 2 is an enlarged view of the accumulator of FIG. 1, partially cut away.

Drum 11 is mounted to a shaft 15 driven by a drive unit 16. Shaft 15 has an upwardly extending shaft portion 17 (FIG. 2) about which drum 12 is rotatably mounted on bearings 18 and 19. Shaft 15 is rotatably mounted in a fixed support 20 by bearings exemplified at 21. Idler 14 is also rotatably mounted to shaft 17 by bearings 23 and 24. Vertically keyed to idler 14 at 25 is a coupling member 26 receiving an annular frictional brake pad 27. Pad 27 rests on an upper surface of block 11. A plurality of springs 29 are disposed in spring pockets 29a in idler 14 to act on member 26.

As upper block 12 is moved downwardly, the coupling force between member 26 and driven block 11 will be increased. A continuous sleeve 30 is disposed about shaft 17 and has an outwardly extending lower flange 30a providing a seat for bearing 23. A sleeve section 31 extends between bearings 18 and 19. A sleeve section 32 extends between bearings 18 and 24, and a further sleeve section 33 extends between bearings 19 and 18. The sleeve sections 31, 32 and 33 not only act as spacers but as thrust transmitting members as hereinafter described.

Figure 3:
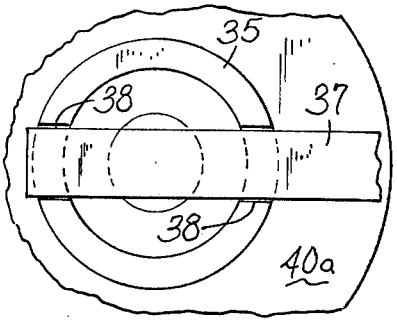
FIG. 3 is a top plan view of a portion of the accumulator of FIG. 2.

Carried on the end of shaft 17 is a shaft extension member 34, which is normally rigid with respect to shaft 17. Extension member 34 is rotatable within a cylindrical member 35 on bearing 36. Member 35 is held against rotation by means of an arm 37 which normally rests in a slot 38 (FIG. 3) on member 35. Arm 37 is pivoted at a point 39 outside of the diameter of block 12 in order to permit removal of wire from block 12 should the necessity arise. A frictional coupling adjusting member 40 has internal threads 41 engaging external threads 42 on member 35, and is rotatable with respect to shaft 17 on bearing 43. A sleeve section 44 spaces bearings 18 and 43 and also acts as a thrust transmitting member. A lock nut 45 is secured to sleeve 31 above bearing 43. A lock washer 46 is carried in member 40 over bearing 43.

With this arrangement, when adjusting member 40 is rotated, as by means of a handwheel 40a attached thereto to move member 40 downwardly with respect to member 35, a force is exerted through bearings 43, 19, 18 and 24 and sleeve 44, 31, 32 and 33, and through idler 14 to compress springs 29 and force coupling member 26 downwardly. This increases the frictional coupling between upper block 10 and lower block 11 through pad 27. The coupling force is applied to pad 27 through springs 29 and coupling member 26. It will be noted that unless otherwise limited, idler 14 could bottom on coupling member 26, resulting in a very high degree of coupling between drums 11 and 12 and to block 11. Also, if the coupling force is very high, the outgoing wire from block 12 could be broken if too great a tension is exerted thereon.

Idler 14 is permitted to rotate in only one direction with respect to block 11 by means of a one-way clutch 47, coupling it to drum 12. Idler 14 rotates in the same direction as block 12.

Means are provided to limit the frictional coupling force between the blocks. An elongated bore 50 is defined in shaft 17 from its upper end and is closed by a nut 51 having a passage therethrough for a shaft 52. Shaft 52 has a spring seat 53 received at the lower end thereof and a collar 54 affixed thereto and bearing against shaft extension member 34 in a seat 55 provided therefor. A spring 56 is disposed between seat 53 and nut 51. Nut 51 and member 34 are splined to permit vertical movement of member 34. The energy to be stored in spring 56 may be set by the position of seat 53 on shaft 52.

Figure 5:
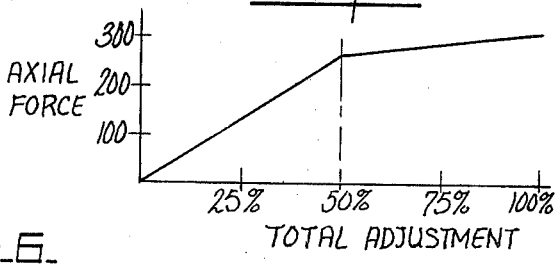
FIG. 5 is a graphical representation of the coupling force which is applied with respect to coupling force adjustment.

Reference is now made to FIG. 5 which typifies a relationship of the axial coupling force exerted between blocks 11 and 12 through pad 27 as a function of downward motion of block 12. The abscissa is the percent of total linear movement of member 40 and the ordinate is the axial coupling force between blocks. Assume spring 56 is compressed to a force of two hundred and fifty pounds. So long as the coupling between the drums does not exceed this coupling force, the spring may be considered as non-existent and member 34 is rigid with shaft 17. The spring is pulling shaft 52 and coupling member 26 downwardly with the assumed force of two hundred and fifty pounds. However, when the frictional force exerted on pad 22 reaches the assumed value of two hundred and fifty pounds, then further rotation of member 40 by hand-wheel 40a will result in member 53 moving upwardly with respect to nut 40.

Otherwise stated, continued rotation of member 40a to increase the coupling between the drums results in relative vertical movement of member 34 on member 35 as member 35 moves upwardly on threads 41.

Figure 6:
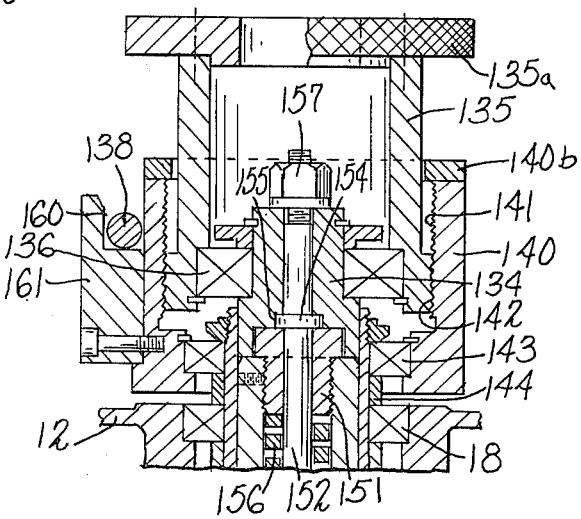
FIG. 6 is a view similar to FIG. 4 but showing an alternate embodiment of the invention.

As shown in FIG. 6, when at the arbitrarily selected value of two hundred and fifty pounds, further attempt to move member 40 vertically results in a substantially decreased rate of application of the axial frictional force.

Figure 4:
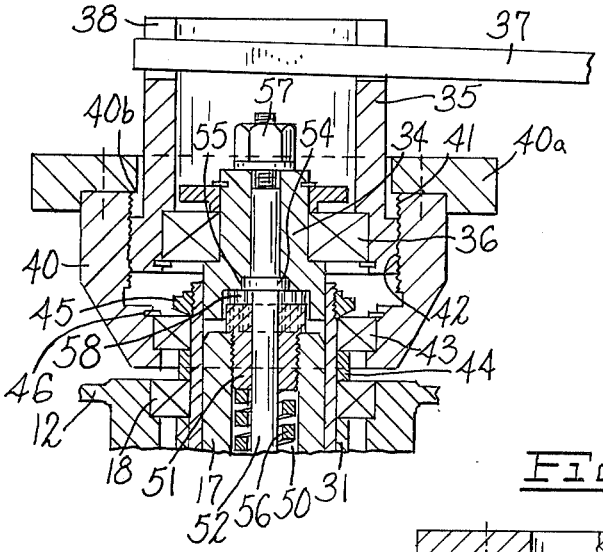
FIG. 4 is a view of a portion of the accumulator of FIG. 2 in section exemplifying the operation of the coupling limiting mechanism.

The upward movement of member 34 is exemplified in FIG. 4 by the space 58 shown between nut 51 and member 34. As handwheel 40a is further rotated past the 50% adjustment point (FIG. 5), the rate of application of axial force with rotation of handwheel 40a will substantially decrease. Then, when 100% adjustment is reached, the slight overhang 40b of handwheel 40a will prevent further downward movement of member 40 and also block 12. The lesser rate of increase of the axial force after the 50% adjustment point permits a finer adjustment of the coupling force.

FIG. 6 shows an alternate arrangement of the invention where similar parts are identified by similar reference numerals advanced by one hundred. Here, member 140 is normally held against rotation by an arm 138 received in a slot 160 defined on member 161 attached to member 140. A handwheel 135a is attached to member 135.

As handwheel 135a is rotated to increase the coupling force, member 140 is forced downwardly on drum 12 through bearing 143 and sleeve 144. Travel of member 140 is limited by ring 140b. Prior to this limit of travel being reached and when the predetermined spring pressure is exceeded, member 134 will be lifted from nut 151.

As nut 51 or 151 is lifted by spring 56 or 156, respectively, the spring is further compressed. This further compression determines the slope of the curve of FIG. 5 beyond the 50% adjustment point. Therefore, the spring constant primarily determines this portion of the curve.

It may thus be seen that the objects of the invention set forth as well as those made apparent from the foregoing description are efficiently attained. While preferred embodiments of the invention have been set forth for purposes of disclosure, modifications to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

I claim:

1. In a double block accumulator of the type comprising a driven lower block for drawing wire and an upper coaxial block rotatable relative to the lower block where the wire is first wound on the lower block and then wound on the upper block in the reverse direction, pressure responsive frictional coupling means disposed between said blocks, and means for varying the coupling pressure on said coupling means; said means for varying the pressure being effective to vary the pressure at a predetermined rate with movement thereof, and means for limiting the coupling pressure that can be applied to said coupling means by said varying means to a predetermined value while still permitting relative rotation between said upper and lower blocks.

2. In a double block accumulator of the type comprising a driven lower block for drawing wire and an upper coaxial block rotatable relative to the lower block where the wire is first wound on the lower block and then wound on the upper block in the reverse direction, pressure responsive frictional coupling means disposed between said blocks, and means for varying the coupling pressure on said coupling means; said means for varying the pressure being effective to vary the pressure at a predetermined rate with movement thereof, means for limiting the coupling pressure that can be applied to said coupling means, and means responsive to the coupling pressure reaching a predetermined value for changing the rate at which pressure is increased with movement of said varying means to a lower value.

3. In a double block accumulator of the type comprising a driven lower block for drawing wire and an upper coaxial block rotatable relative to the lower block where the wire is first wound on the lower block and then wound on the upper block in the reverse direction, the upper block being rotatably mounted about an extension of a drive shaft of the lower block, pressure responsive frictional coupling means disposed between said blocks, and means for varying the coupling pressure on said coupling means; said means for varying the coupling pressure comprising first and second members mounted to said shaft extension for relative rotation, means for restraining one of first and second members from rotation, said first and second members being threaded together whereby rotation of one of said first and second members while the other is restrained from rotation produces axial movement of the restrained member, thrust means for transmitting downward movement of said restrained member to said coupling means through said upper block, and means for limiting relative axial movement of said first and second members to thereby limit the coupling pressure that can be applied to said coupling means through said upper block to a predetermined value while still permitting relative rotation between said upper and lower blocks.

4. The accumulator of claim 3 further comprising an extension member coupled to said shaft extension at the end thereof by resilient biasing means having a predetermined force therein, said biasing means holding said extension member fast to said shaft extension so long as the axial coupling force between said blocks does not exceed said predetermined force, one of said first and second members mounted to said extension member, whereby when said coupling force exceeds said predetermined force said biasing means raises said extension member from said shaft extension.

5. The accumulator of claim 4 wherein said shaft extension has a hollow bore, a shaft extending through said extension member into said hollow bore and having a spring seat thereon, said biasing means comprising a spring disposed about said shaft between said seat and said extension member and compressed to said predetermined force to couple said extension member to said shaft extension whereby after the coupling force exceeds the force of said spring, one of said first and second members on said extension member will move in the opposite direction to the other of said first and second members as the other of said first and second members is rotated to increase the coupling pressure.

6. A double block accumulator of the type including a lower block on a driven shaft, an upper block rotatably mounted to an extension of said driven shaft, frictional coupling means disposed between said blocks, first and second members rotatably mounted to said shaft extension at the upper end thereof and threaded to each other, means normally holding one of said first and second members against rotation, whereby rotation of the other of said first and second members produces linear movement of the other, thrust transmitting means between said linearly movable member and said upper block whereby when said linearly movable member moves downwardly it forces said upper block downwardly to increase the pressure on said frictional coupling means between said blocks, an extension member coupled to said shaft extension at the end thereof by resilient biasing means having a predetermined force therein, said biasing means holding said extension member fast to said shaft extension so long as the axial coupling force between said blocks does not exceed said predetermined force, one of said first and second members mounted to said extension member, whereby when said coupling force exceeds said predetermined force said biasing means raises said extension member from said shaft extension.

7. The accumulator of claim 6 wherein said means normally holding one of said first and second members is a rod-like member pivoted at a point outside the diameter of said upper block and arranged to engage said member to prevent rotation thereof.

8. The accumulator of claim 6 wherein said shaft extension has a hollow bore, a shaft extending through said extension member into said hollow bore and having a spring seat thereon, said biasing means comprising a spring disposed about said shaft between said seat and said extension member and compressed to said predetermined force to couple said extension member to said shaft extension whereby after the coupling force exceeds the force of said spring, one of said first and second members on said extension member will move in the opposite direction to the other of said first and second members as the other of said first and second members is rotated to increase the coupling pressure.

* * * * *